US008555795B2

(12) United States Patent
Cheng et al.

(10) Patent No.: US 8,555,795 B2
(45) Date of Patent: Oct. 15, 2013

(54) PULVERIZED COAL CONCENTRATOR AND PULVERIZED COAL BURNER INCLUDING THE CONCENTRATOR

(75) Inventors: Changye Cheng, Yantai (CN); Jiaju Yang, Yantai (CN); Yi Li, Yantai (CN); Xingyuan Cui, Yantai (CN); Chaoqun Zhang, Yantai (CN); Zeru Gong, Yantai (CN); Guangquan Zhang, Yantai (CN); Yubin Zhang, Yantai (CN); Peng Liu, Yantai (CN)

(73) Assignee: Yantai Longyuan Power Technology Co., Ltd., Yantai (CN)

( * ) Notice: Subject to any disclaimer, the term of this patent is extended or adjusted under 35 U.S.C. 154(b) by 78 days.

(21) Appl. No.: 13/257,584

(22) PCT Filed: Mar. 23, 2010

(86) PCT No.: PCT/CN2010/000354

§ 371 (c)(1),
(2), (4) Date: Sep. 19, 2011

(87) PCT Pub. No.: WO2010/108386

PCT Pub. Date: Sep. 30, 2010

(65) Prior Publication Data

US 2012/0006238 A1 Jan. 12, 2012

(30) Foreign Application Priority Data

Mar. 24, 2009 (CN) ..... 2009 1 0119640

(51) Int. Cl.
*F23D 1/00* (2006.01)
*F23K 3/02* (2006.01)

(52) U.S. Cl.
CPC ..... *F23D 1/00* (2013.01); *F23D 2201/20* (2013.01); *F23K 3/02* (2013.01)
USPC ..... 110/104 B; 110/261; 110/263; 406/181

(58) Field of Classification Search
CPC ..... F23D 1/00; F23D 1/04; F23D 2201/20; F23D 2900/00018; F23D 2900/11402; F23K 3/02
USPC ..... 110/263, 104, 104 R, 261, 154, 262, 110/623, 264, 265, 309, 310, 347, 106; 431/186, 127, 128, 263, 264; 406/56, 406/181; 239/533.1
See application file for complete search history.

(56) References Cited

U.S. PATENT DOCUMENTS 2,932,498 A * 4/1960 Metcalfe et al. ..... 432/32
4,274,343 A * 6/1981 Kokkinos ..... 110/263

(Continued)

FOREIGN PATENT DOCUMENTS

CN 2632505 Y 8/2004
CN 1786579 A 6/2006

(Continued)

OTHER PUBLICATIONS

International Search Report mailed Jun. 24, 2010, issued in corresponding International Application No. PCT/CN2010/000354, filed Mar. 13, 2010, 3 pages.

(Continued)

*Primary Examiner* — Kenneth Rinehart
*Assistant Examiner* — David J Laux
(74) *Attorney, Agent, or Firm* — Christensen O'Connor Johnson Kindness PLLC

(57) ABSTRACT

A pulverized coal concentrator for a pulverized coal burner, the concentrator is fixedly arranged inside the pulverized coal burner and comprises a front part (102) and a rear part (101), wherein the front part (102) is designed as a bowl-shaped structure, for guiding and concentrating an air-pulverized coal flow, and the rear part (101) is designed as a cylinder-shaped structure, for maintaining a proper extension of the dense phase zone of the air pulverized coal flow. Also a pulverization coal burner is provided comprising the pulverized coal concentrator, in particular an internal combustion-type pulverized coal burner. The pulverized coal concentrator increases the adaptability of burner to coal quality, air velocity and pulverized coal density.

14 Claims, 9 Drawing Sheets

(56) References Cited

U.S. PATENT DOCUMENTS

| | | | | | |
|---|---|---|---|---|---|
| 4,412,810 | A * | 11/1983 | Izuha et al. | 431/186 |
| 4,422,391 | A * | 12/1983 | Izuha et al. | 110/347 |
| 4,479,442 | A * | 10/1984 | Itse et al. | 110/261 |
| 4,497,263 | A * | 2/1985 | Vatsky et al. | 110/347 |
| 4,634,054 | A * | 1/1987 | Grusha | 239/423 |
| 4,734,028 | A * | 3/1988 | Musil | 431/175 |
| 4,862,814 | A * | 9/1989 | Campbell et al. | 110/264 |
| 4,899,670 | A * | 2/1990 | Hansel | 110/264 |
| 5,156,100 | A * | 10/1992 | Pentti | 110/347 |
| 5,231,937 | A * | 8/1993 | Kobayashi et al. | 110/262 |
| 5,347,937 | A * | 9/1994 | Vatsky | 110/261 |
| 5,454,712 | A * | 10/1995 | Yap | 431/10 |
| 5,483,906 | A * | 1/1996 | Hufton | 110/260 |
| 5,526,758 | A * | 6/1996 | Giammaruti et al. | 110/263 |
| 5,588,380 | A * | 12/1996 | LaRose | 110/263 |
| 5,593,302 | A * | 1/1997 | Althaus et al. | 431/353 |
| 5,685,242 | A * | 11/1997 | Narato et al. | 110/262 |
| 5,697,306 | A * | 12/1997 | LaRue et al. | 110/261 |
| 5,842,426 | A * | 12/1998 | Ohta et al. | 110/261 |
| 5,937,770 | A * | 8/1999 | Kobayashi et al. | 110/263 |
| 6,053,118 | A * | 4/2000 | Okamoto et al. | 110/261 |
| 6,058,855 | A * | 5/2000 | Ake et al. | 110/214 |
| 6,089,171 | A * | 7/2000 | Fong et al. | 110/263 |
| 6,105,516 | A * | 8/2000 | Bowen | 110/261 |
| 6,171,100 | B1 * | 1/2001 | Joshi et al. | 431/182 |
| 6,260,491 | B1 * | 7/2001 | Grusha | 110/261 |
| 6,439,136 | B1 * | 8/2002 | Mann et al. | 110/263 |
| 6,474,250 | B1 * | 11/2002 | Penterson et al. | 110/261 |
| 6,475,267 | B1 * | 11/2002 | Lehn | 95/271 |
| 6,684,796 | B1 * | 2/2004 | Feldermann | 110/347 |
| 6,699,031 | B2 * | 3/2004 | Kobayashi et al. | 431/10 |
| 6,895,756 | B2 * | 5/2005 | Schmotolocha et al. | 60/761 |
| 6,986,311 | B2 * | 1/2006 | Vatsky et al. | 110/262 |
| 7,028,622 | B2 * | 4/2006 | Taylor | 110/265 |
| 7,273,366 | B1 * | 9/2007 | Sujata | 431/5 |
| 7,281,478 | B2 * | 10/2007 | Wang et al. | 110/347 |
| 7,430,970 | B2 * | 10/2008 | LaRue et al. | 110/347 |
| 7,665,458 | B2 * | 2/2010 | Waltz et al. | 126/290 |
| 7,681,508 | B2 * | 3/2010 | Taniguchi et al. | 110/214 |
| 7,833,009 | B2 * | 11/2010 | Joshi et al. | 431/12 |
| 7,913,632 | B2 * | 3/2011 | Jia et al. | 110/347 |
| 8,302,544 | B2 * | 11/2012 | Takashima et al. | 110/104 B |
| 2009/0038518 | A1 * | 2/2009 | Liu et al. | 110/263 |
| 2010/0154688 | A1 * | 6/2010 | Adam et al. | 110/261 |
| 2010/0154689 | A1 * | 6/2010 | Adam et al. | 110/265 |
| 2011/0210191 | A1 * | 9/2011 | Adam et al. | 239/591 |
| 2012/0131813 | A1 * | 5/2012 | Hogan | 34/403 |
| 2012/0186501 | A1 * | 7/2012 | Zarnescu et al. | 110/101 R |
| 2012/0192773 | A1 * | 8/2012 | Satchell et al. | 110/348 |
| 2012/0237304 | A1 * | 9/2012 | Zarnescu | 406/181 |

FOREIGN PATENT DOCUMENTS

| | | | |
|---|---|---|---|
| CN | 200965228 | * | 10/2007 |
| CN | 200965228 | Y | 10/2007 |
| CN | 101135445 | A | 3/2008 |
| CN | 201126192 | Y | 10/2008 |
| CN | 101592337 | A | 12/2009 |
| CN | 201377792 | Y | 1/2010 |
| JP | 2005024136 | A | 1/2005 |
| WO | 2009143725 | A1 | 12/2009 |

OTHER PUBLICATIONS

Russian Official Action dated Dec. 17, 2012, issued in corresponding Russian Application No. 2011142737, filed Mar. 23, 2010, 13 pages.

* cited by examiner

PULVERIZED COAL CONCENTRATOR AND PULVERIZED COAL BURNER INCLUDING THE CONCENTRATOR

CROSS-REFERENCES TO RELATED APPLICATIONS

This application is the National Stage of International Application No. PCT/CN2010/000354, filed Mar. 23, 2010, which claims priority from Chinese Application No. 200910119640.3, filed Mar. 24, 2009. Each application is incorporated herein by reference in its entirety.

TECHNICAL FIELD

The present invention relates to a pulverized coal concentrator for a pulverized coal burner of a pulverized-coal fired boiler, in particular a pulverized coal concentrator for an internal-combustion type pulverized coal burner, and to a pulverized coal burner comprising such a pulverized coal concentrator.

TECHNICAL BACKGROUND

Around the world, the conventional power plants and many industrial pulverized coal boilers burn heavy oil, diesel oil or natural gas, for the starting ignition and low-load combustion stabilization thereof, to achieve the ignition of pulverized coal. So in each year, a plenty of fuel oil is consumed. Recently, the developed plasma ignition and combustion stabilizing technique save fuel oil to a large extent and realize starting of pulverized coal boiler without oil. The Chinese patent CN03268412.6 discloses a staged igniting burner, as shown in FIG. 12, it comprises an external burning chamber 4, an igniting source (not shown), wherein a central chamber 1 is provided inside the external burning chamber 4, and n stages of internal burning chambers 2, 3, . . . , are provided between the central chamber 1 and the external burning chamber 4, the pulverized coal is ignited by the igniting source inside the central burning chamber 1, and the pulverized coal flame ignited in the central burning chamber 1 is used to ignite the pulverized coal inside the next stage of internal burning chamber 2, and then the pulverized coal inside the next burning chamber 3 is ignited accordingly stage by stage, and finally the pulverized coal inside the last stage of burning chamber 4 is ignited and then enters the furnace to take part in combustion.

The Chinese patent CN200720146244.6 discloses a plasma burner, as shown in FIG. 13, it comprises at least two stages of burning chambers 14, 16 as well as a plasma generator 31 for ignition of pulverized coal in the first stage burning chambers 14 of the at least two stages of burning chambers, wherein the flame of the pervious stage of burning chamber 14 ignites the pulverized coal in the next stage of burning chamber 16 or further burns with the supplemented air in the next stage of burning chamber 16, wherein the axial direction of the plasma generator is parallel to the direction in which the air-pulverized coal flow 32 enters the first stage of burning chamber 14, and at the same time is parallel to the axis of the burning chambers 14, 16.

The above patents discloses the multi-stage chamber structure of plasma pulverized coal burner which contains the following drawbacks: insufficient adaptability of the plasma pulverized coal burner to coal quality, air velocity and pulverized coal density, and insufficient ignition stabilization and reliability.

INVENTION SUMMARY

The present invention aims to providing a pulverized coal concentrator and a pulverized coal burner using such a pulverized coal concentrator, particularly suitable for a pulverized coal burner of internal combustion ignition and stabilization type, so as to increase adaptation of the pulverized coal burner to coal quality, air velocity and pulverized coal density.

In accordance with the present inventive pulverized coal concentrator, it is fixedly arranged inside a pulverized coal burner and comprises a front part and a rear part, characterized in that, the front part is designed as a bowl-shaped structure, for guiding and concentrating a gas-solid two-phase flow consisted of concentrated pulverized coal and air (hereinafter referred to as "air-pulverized coal flow"), and the rear part is designed as a cylinder-shaped structure, for maintaining a proper extension of the dense phase zone of the air-pulverized coal flow.

Preferably, the present inventive pulverized coal concentrator is designed as an integral structure, that is, the front part and the rear part are made integrally and the front part and/or the rear part are arranged fixedly; or, the present pulverized coal concentrator is designed as a split structure, that is, the front part and the rear part are made separately respectively, wherein the front part is connected with the rear part and the front part and/or the rear part are arranged fixedly; or the front part and rear part are arranged apart in a distance one from another and the front part and the rear part are arranged fixedly respectively.

Herein, the above distance can be particularly determined according to the coal quality, the structural size of component parts, the requirements on the pulverized coal ignition and combustion stabilization as well as the aerodynamic field inside boiler furnace and so on.

In the present inventive pulverized coal concentrator, by dense-weak separation of pulverized coal via the bowl-shaped structure of the front part, a portion of dense coal air pulverized coal flow enters the bowl-shaped structure, and the thin coal air pulverized coal flow enters a next stage of burner chamber, so that the air-pulverized coal flow inside the bowl-shaped structure is concentrated to a density level suitable for ignition; and at the same time due to the flow guidance of the bowl-shaped structure, the pulverized coal is forcedly introduced into the plasma flame area (or other heat ignition source), producing a heat temperature ignition effect, so that the pulverized coal volatile component and the coke particles are ignited simultaneously, to realize non-homogenous combustion in the earlier ignition process and the pulverized coal particles are rapidly ignited. At the same time, by the cylinder-shaped structure of the rear part, a proper extension of the pulverized coal dense phase zone (with respect to pulverized coal density, there is a dense phase zone and a thin phase zone, wherein the zone in which pulverized coal occupies a large proportion in the air pulverized coal flow is called the dense phase zone, and the rest zone is called the thin phase are) can be held, so as to realize a heat collection effect, so that the effective flame source is controlled into a narrow zone to prevent heat dissipation of flame source, which facilitates forming of a steady flame and then igniting coal particles outside the concentrator.

According to a preferable embodiment of the present invention, the front part has a bowl opening and a bowl bottom opening, an inlet of the rear part is connected with the bowl opening or the bowl bottom opening, or the inlet of the rear part is connected to a wall between the bowl opening and the bowl bottom opening of the front part.

According to a preferable embodiment of the present invention, a bowl bottom opening of an additional bowl-shaped component is connected to an outlet of the cylinder-shaped rear part, and the bowl opening of the bowl-shaped front part is facing away from a bowl opening of the additional bowl-shaped component. In adjacency of the additional bowl-shaped structure an eddy zone will form to intensify the pulverized coal flame combustion.

According to a preferable embodiment of the present invention, the size of the bowl opening is larger than that of the bowl bottom opening.

According to a preferable embodiment of the present invention, through holes are made in the bowl-shaped wall of the front part, in particular in adjacency to the bowl bottom.

According to a preferable embodiment of the present invention, the axial length of the front part is smaller than that of the rear part.

According to a preferable embodiment of the present invention, the bowl-shaped front part is formed by connection of several planes or is consisted of a camber or is the combination of the both. The bowl-shaped front part is preferably consisted of a circular camber.

According to a preferable embodiment of the present invention, the cylinder-shaped rear part is formed by connection of several planes or is consisted of a camber or is the combination of the both. The bowl-shaped front part is preferably consisted of a circular camber.

According to a preferable embodiment of the present invention, the cylinder-shaped rear part is a horizontal straight cylinder, a gradually expanding cylinder or a gradually narrowing cylinder or their combination. Herein, the rear part is preferably a gradually expanding structure, which can decrease the flow velocity of air-pulverized coal flow and increase the residence time of pulverized coal in the firing section. Of course, as for coal having low volatile component and high water and ash component, the gradually narrowing structure can be used for increasing fire collection capability. Thus, the rear part preferably comprises at least a gradually expanding cylinder and/or gradually narrowing cylinder.

According to a preferable embodiment of the present invention, through holes are made in the bowl wall of the bowl-shaped front part. Preferably, through holes are made in adjacency to the bowl bottom of the bowl-shaped front part. Through the holes in the bowl wall of the bowl-shaped structure, weak phase air-pulverized coal flow can be concentrated and shunted to retain dense phase air-pulverized coal flow, balance pressure difference, decrease air velocity and depress the negative influence on firing due to augmentation of flow velocity, so that at the same time of increasing of pulverized coal density, the flow velocity of air pulverized coal flow does not increase in a same proportion.

According to a preferable embodiment of the present invention, the rear part is provided at its outlet edge with a castellation structure, which can be a tooth-like structure or a petal-like structure. Preferably, the tooth-like or petal-like castellation structure has an angle of 0°-90° (that is, the teeth or petal castellations extend outwards perpendicularly to the chamber axis, it is 90°, or the teeth or petal castellations extend parallel to the chamber axis, it is 0°). Through the tooth-like castellation structure or the petal-like castellation structure at the outlet edge of the rear part, a firing front edge disturbance of pulverized coal can be increased to form a backflow and an eddy so as to improve combustion. Such a structure can be used in ease of slightly poor coal quality.

According to a preferable embodiment of the present invention, the wall of the cylinder-shaped rear part is also provided with through holes. Through these holes, pressure difference can be balanced to decrease the air velocity inside the rear part so as to improve firing. The quantity, shape and size of the holes can be set as practically demanded. Herein the holes can be inclined holes or straight holes, wherein inclined holes have better concentrating and shunting effect than straight holes.

According to a preferable embodiment of the present invention, the inlet of the bowl-shaped front part is of a square or circular structure or is of an angled tooth-like or petal-like structure (similar to the tooth-like or petal-like structure at the outlet/nozzle of the rear part). Through this embodiment, concentration and uniform flow can also be realized.

According to a preferable embodiment of the present invention, an additional cylinder is arranged at the inside of or outside of the rear part, and an interlayer space is formed between the additional cylinder and the cylinder-shaped rear part. The additional cylinder is arranged in such a manner that the holes in the wall of the front part is housed inside by the interlayer space and thus there is air-pulverized coal flow in the interlayer space, or that the holes in the wall of the front part is not housed inside by the interlayer space and thus there is no air-pulverized coal flow in the interlayer space. Through this interlayer space, the effects can be achieved, such as heat preservation and collection, separation of hot-cold medium, forming of central dense phase are as well as secondary firing front edge oxygen-supplementation and disturbance etc.

According to a preferable embodiment of the present invention, a multiple-stage combination structure of the pulverized coal concentrators is provided, wherein the rear part of the previous stage of concentrator is nested with the front part of the next stage of concentrator consequently. Thus the effect of single stage of concentrator can be strengthened so that all the advantages of the present inventive concentrator are more prominent, and the adaptability to coal quality, air velocity and pulverized coal density is stronger.

According to a preferable embodiment of the present invention, the front part is arranged coaxially to the rear part.

In accordance with the present inventive pulverized coal burner, particularly an internal combustion type burner (in the conventional burners, pulverized coal is ejected into furnace and then is ignited by oil gun, herein the coal is gradually ignited by means of radiation heat of furnace and the convection heat of high temperature flue gas, but in the internal combustion type burners, the pulverized coal is partially ignited inside the burner to begin fire and burn, and then is conveyed into furnace for combustion), it comprises the above-mentioned pulverized coal concentrator.

According to a preferable embodiment of the present invention, the pulverized coal burner also comprises at least one stage of burner chamber and an ignition source.

According to a preferable embodiment of the present invention, the pulverized coal concentrator is arranged between the ignition source and a first stage of burner chamber, the ignition source projects into the bowl-shape structure of the concentrator, and/or the outlet of the concentrator, i.e., the outlet of the cylinder-shaped rear part projects into the first stage of burner chamber.

In the burner, due to the application of said pulverized coal concentrator, the ability of heat-collection is increased and the strength of combustion flame is also improved.

According to a preferable embodiment of the present invention, the ignition source, the pulverized coal concentrator and the burner chambers are arranged coaxially relatively to one another.

According to a preferable embodiment of the present invention, the ignition source is a plasma generator or small oil gun or high-temperature air.

According to a preferable embodiment of the present invention, the plasma generator is arranged in a distance of 10-100 mm from the bowl bottom opening of the front part.

In the present inventive pulverized coal burner, coal particles are forcedly introduced into the present concentrator, through dense-weak separation of pulverized coal via the bowl-shaped structure, denser pulverized coal having lower velocity enters the bowl-shaped structure, and weaker pulverized coal flows into the next stage burner chamber, so that the air-pulverized coal flow is concentrated into a density level necessary for ignition of various types of coal. Preferably, small holes are made in the bowl-shaped structure, the weaker air-pulverized coal flow reaches outside of the concentrator through the holes, so the air velocity inside the concentrator is decreased, also decreasing the negative influence on firing due to enlargement of flow velocity The rear cylinder-shaped structure of the concentrator maintains a proper extension of the dense phase zone of pulverized coal, to avoid insufficient combustion by preventing the pulverized coal entering the bowl-shaped structure from contacting with outside cool air-pulverized coal flow too early during the initial of firing, the ignited pulverized coal will not ignite the outside pulverized coal until it forms a stable flame. The glowing flame expands rapidly at the outlet of the concentrator to mix intensively with the pulverized coal in the outer chamber, producing energy larger than the ignition source to ignite the next stage of pulverized coal.

The present invention produces the following effects:

- Through dense-weak separation of pulverized coal via the bowl-shaped structure, denser air-pulverized coal flow enters the bowl-shaped structure, and weaker air-pulverized coal flow enters the following burner chambers so that the air-pulverized coal flow is concentrated to a density level suitable for ignition.
- The pulverized coal is contacted sufficiently with the ignition source to improve rapid burning of pulverized coal.
- There is a substantial heat-collection and temperature-preservation effect for the fired root flame, and the firing reliability is increased.

BRIEF DESCRIPTION OF THE DRAWINGS

In the following, the present invention is described in detail with reference to drawings and embodiments, in which.

EMBODIMENTS

Figure 1:
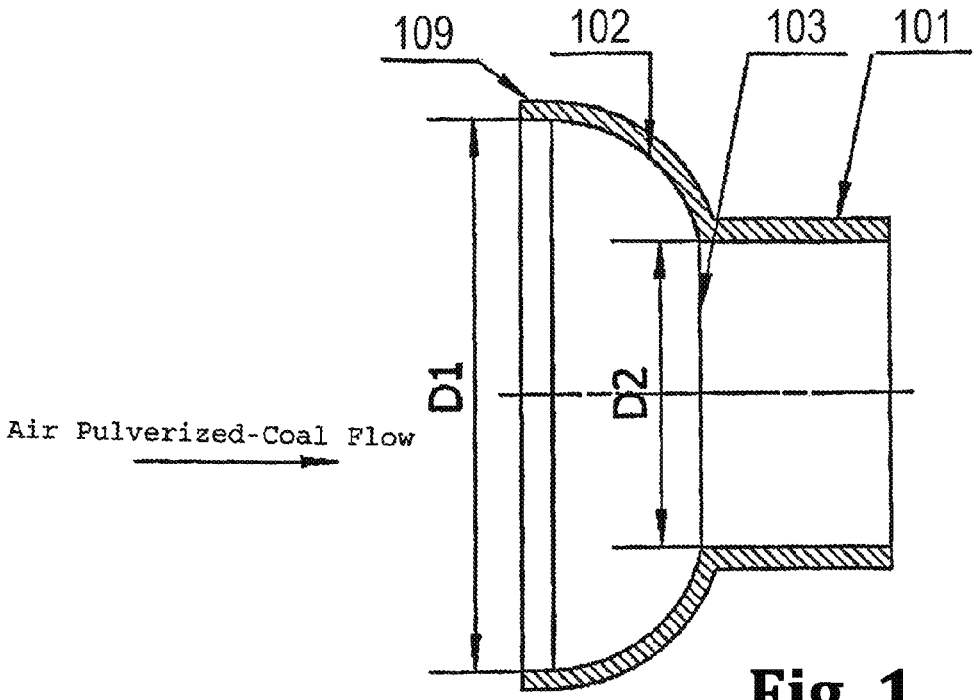
FIG. 1 shows a front view of the pulverized coal concentrator according to a first embodiment of the present invention.

FIG. 1 shows the first embodiment of the pulverized coal concentrator according to the present invention, wherein FIG. 1 shows its front view. The pulverized coal concentrator according to this embodiment comprises a cylinder-shaped rear part 101 and a bowl-shaped front part 102 consisted of a camber, wherein the front part 102 has a bowl opening 109 and a bowl bottom opening 103, which bowl bottom opening 103 is connected with an inlet of the rear part 101. The mixture gas flow of pulverized coal and air (hereinafter referred to "air-pulverized coal flow") enters from the bowl opening 109 into the bowl-shaped front part 102. Through the guidance and concentration effect of the bowl-shaped structure (with big bowl opening and small bowl bottom opening), the air-pulverized coal flow is concentrated to a density level suitable for ignition, then enters the rear part for continuous guiding after it is ignited at the position of the bowl bottom opening 103, and finally the glowing flame expands rapidly at the outlet of the concentrator to mix intensively with the pulverized coal in the next stage chamber, so the coal-coal heat transfer of flame is promoted and it is easy to form an ignition transferring course of coal flame. In the shown structure, the bowl opening 109 has a bigger size D1 than that D2 of the bowl bottom opening 103. Preferably, the axial length of the front part is larger than that of the rear part.

In the present invention, the pulverized coal concentrator can be designed as an integral structure, that is, the front part 102 and the rear part 101 are made integral, such as by casting or mold injection method, or, the pulverized coal concentrator can also be designed as a split structure, wherein the front part 102 and the rear part are made respectively separately, and the front part and the rear part can be connected together or be arranged apart from one another.

Figure 2:
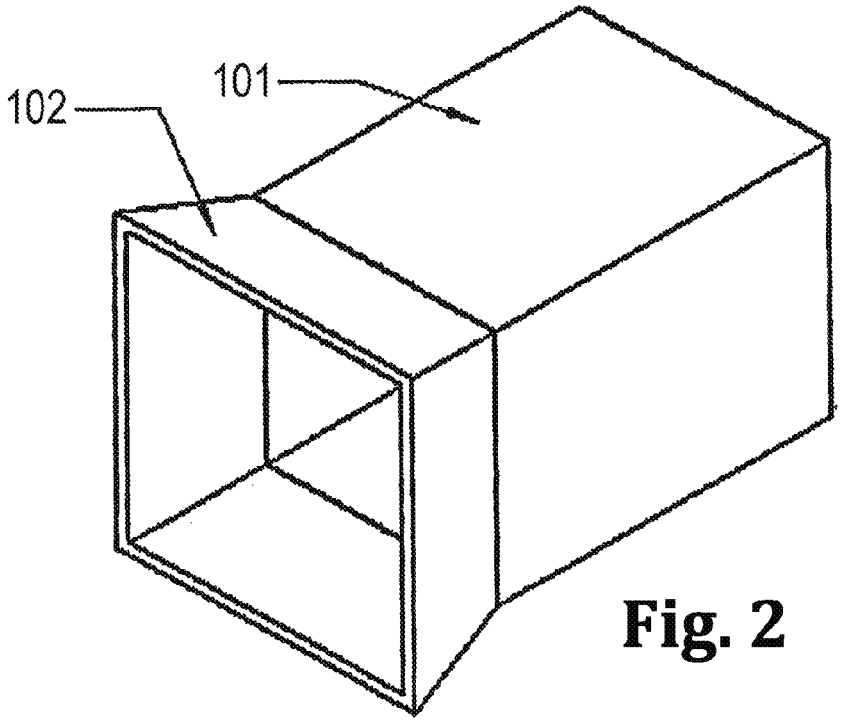
FIG. 2 shows a perspective view of the pulverized coal concentrator according to a second embodiment of the present invention.

FIG. 2 shows a perspective view of the pulverized coal concentrator according to a second embodiment of the present invention. This embodiment differs from the first embodiment in that the cylinder-shaped rear part 101 is consisted of four or more plates and the bowl-shaped rear part 102 is also consisted of four or more plates.

It can also be that the bowl-shaped front part 102 consisted of a camber in FIG. 1 is combined with the cylinder-shaped rear part 101 consisted of several planes in FIG. 2, and vice versa, herein it is not list one by one.

Figure 3:
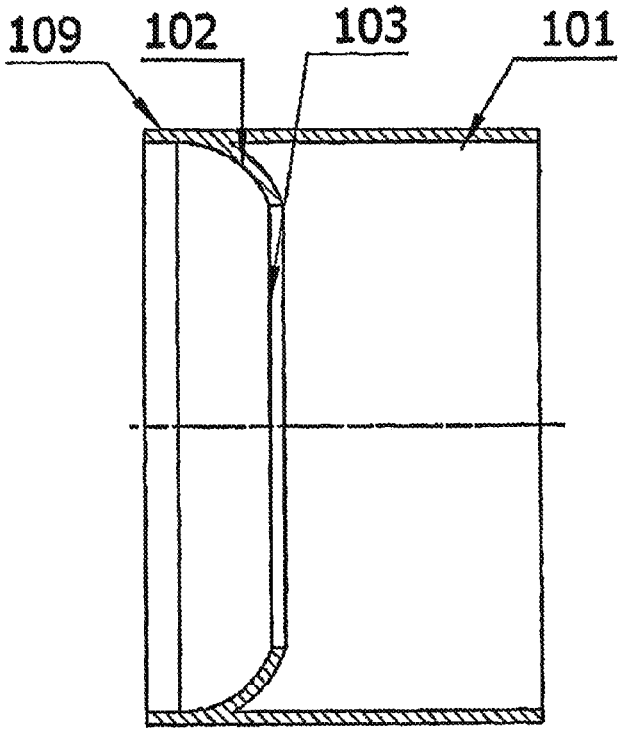
FIG. 3 shows a perspective view of the pulverized coal concentrator according to a third embodiment of the present invention.

FIG. 3 shows a perspective view of the pulverized coal concentrator according to a third embodiment of the present invention. This embodiment differs from the first embodiment in that the cylinder-shaped rear part 101 extends from the bowl opening 109 of the bowl-shaped front part 102. It can also be that an inlet of the cylinder-shaped rear part 101 is connected to a wall of the bowl-shaped front part 102 between the bowl opening 109 and the bowl bottom opening 103.

Figure 4:
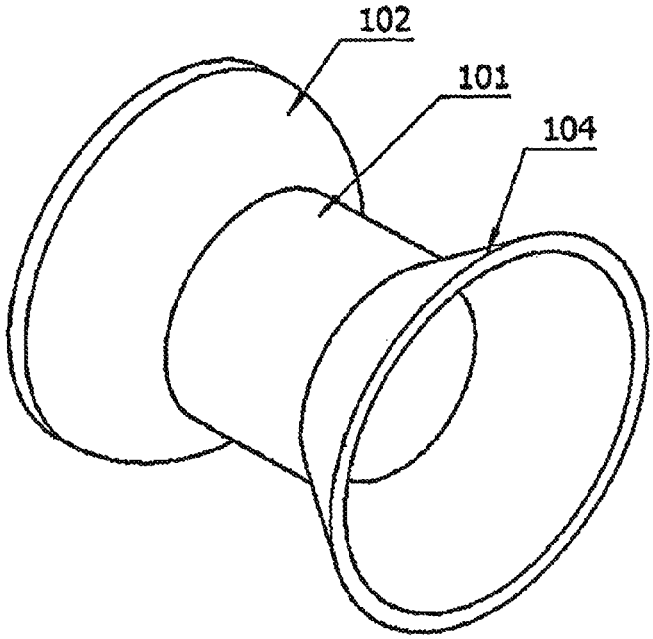
FIG. 4 shows a perspective view of the pulverized coal concentrator according to a fourth embodiment of the present invention.

FIG. 4 shows a perspective view of the pulverized coal concentrator according to a fourth embodiment of the present invention. This embodiment differs from the first embodiment in that a conical cylinder 104 is connected at the outlet of the cylinder-shaped rear part 101. In the invention, the cylinder-shaped structure of the rear part can also be designed as a straight cylinder, a gradually expanding cylinder or a gradually narrowing cylinder, or their combination in various forms. In the sense of the invention, such combination can be wholly regarded as a "rear part". This wholly "rear part" has an axial length larger than that of the bowl-shaped front part.

Figure 5:
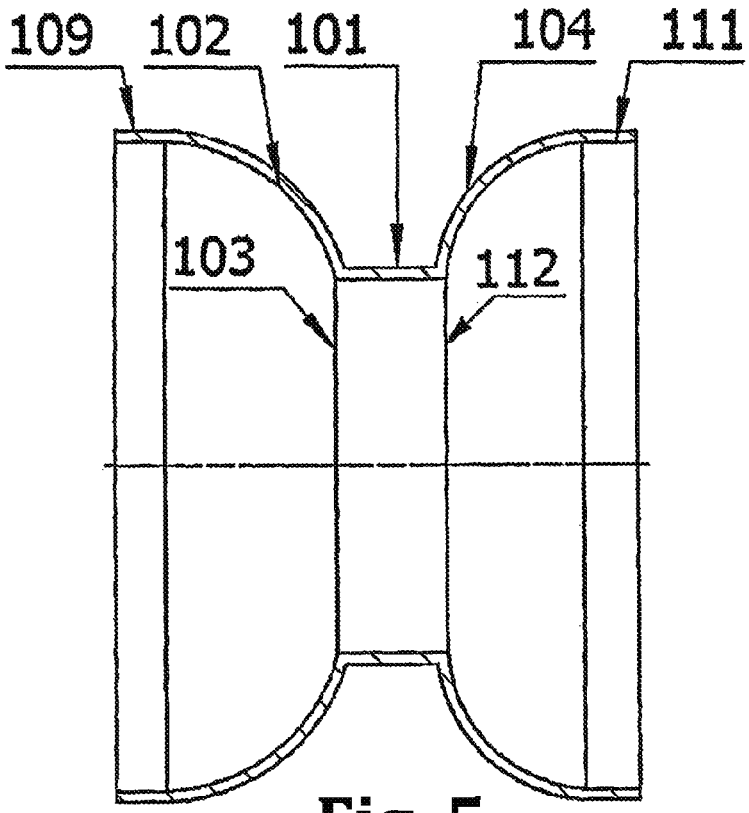
FIG. 5 shows a front view of the pulverized coal concentrator according to a fifth embodiment of the present invention.

FIG. 5 shows a front view of the pulverized coal concentrator according to a fifth embodiment of the present invention. In this embodiment, a bowl bottom opening 103 of an additional bowl-shaped component 104 is connected at the outlet of the cylinder-shaped rear part 101, and the bowl opening of the bowl-shaped front part 102 is facing away from the additional bowl-shaped component 104. In the shown structure, the size D1 of the bowl opening 109 is larger than the size D2 of the bowl bottom opening 103. Likely, the size of the bowl opening 111 is larger than that of the bowl bottom opening 112. In the sense of the invention, such a combination of the middle straight cylinder with the additional bowl-shaped component 104 can also wholly be regard as a "rear part". This wholly "rear part" has an axial length preferably larger than that of the bowl-shaped front part.

Figure 6A:
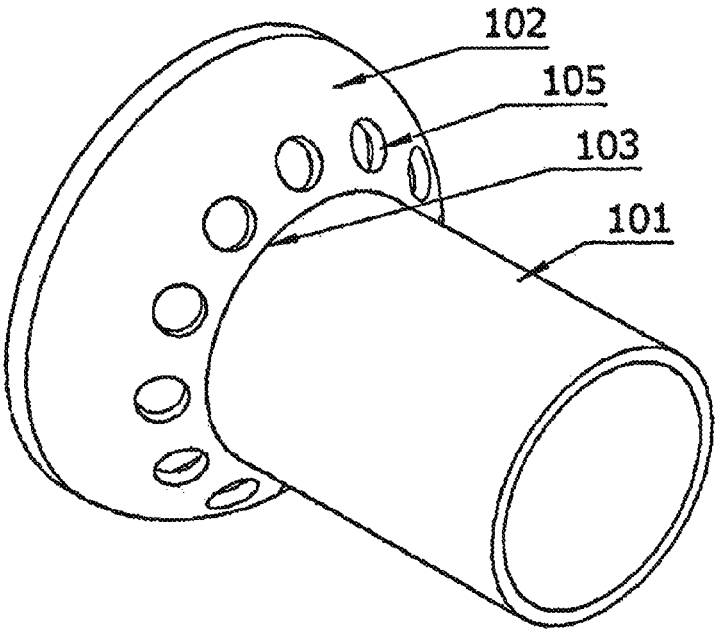
FIGS. 6A and 6B show perspective views of the pulverized coal concentrator according to a sixth embodiment of the present invention.
Figure 6B:
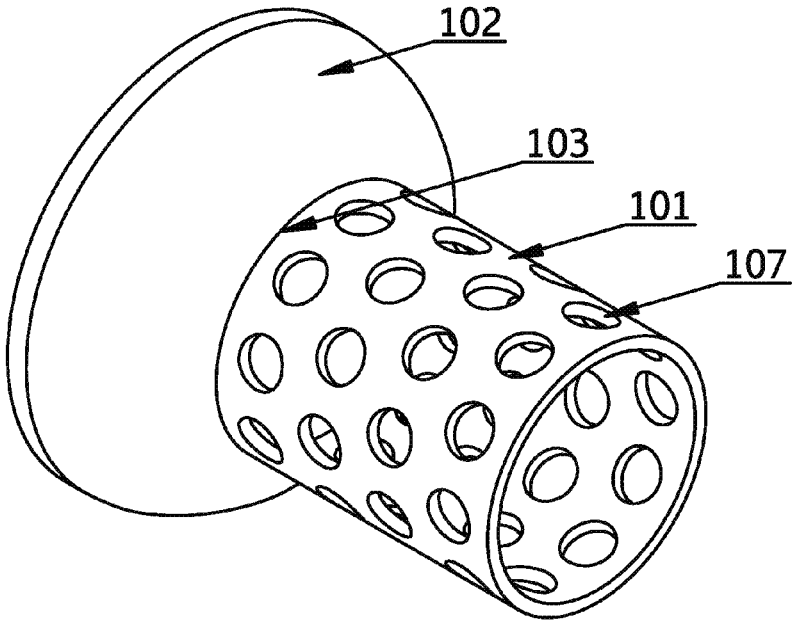

FIG. 6A shows a perspective view of the pulverized coal concentrator according to a sixth embodiment of the present invention. In this embodiment, many holes 105 are distributed over the circumferential wall of the front part 102. These holes are preferably provided in a position adjacent to the bowl bottom opening 103 in the circumferential wall of the front part 102. The quantity, shape and size of holes are to be set as practically required. The holes may have inclined or straight shape. Alternatively or complementarily, such holes 107 can also be distributed over the circumferential wall of the rear part 101, as shown in FIG. 6B.

Figure 7:
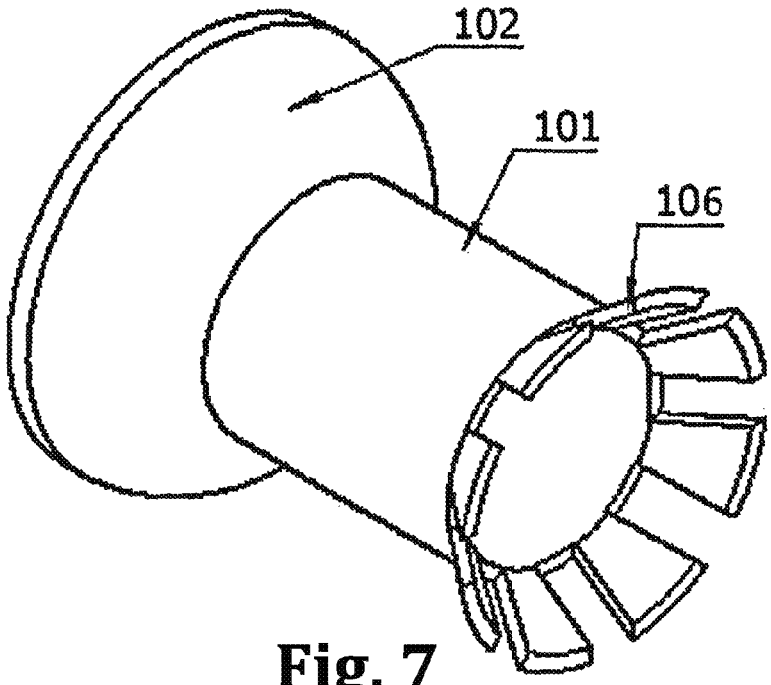
FIG. 7 shows a perspective view of the pulverized coal concentrator according to a seventh embodiment of the present invention.

FIG. 7 shows a perspective view of the pulverized coal concentrator according to a seventh embodiment of the present invention. This embodiment differs from the first embodiment in that an angled tooth-like castellation structure 106 is arranged at a nozzle of the cylinder-shaped rear part 101, i.e. its outlet circumferential edge. Preferably, the angle of the teeth-like castellations are 0°-90° (the teeth-like castellation structures extend outwards perpendicularly to the chamber axis, it is 90°, or the teeth-like castellation structures extend parallel to the chamber axis, it is 0°). Instead of the angled tooth-like castellation structure 106 arranged at the nozzle of the cylinder-shaped rear part 101/its outlet circumferential edge, an angled petal-like castellation structure can also be provided.

Figure 8:
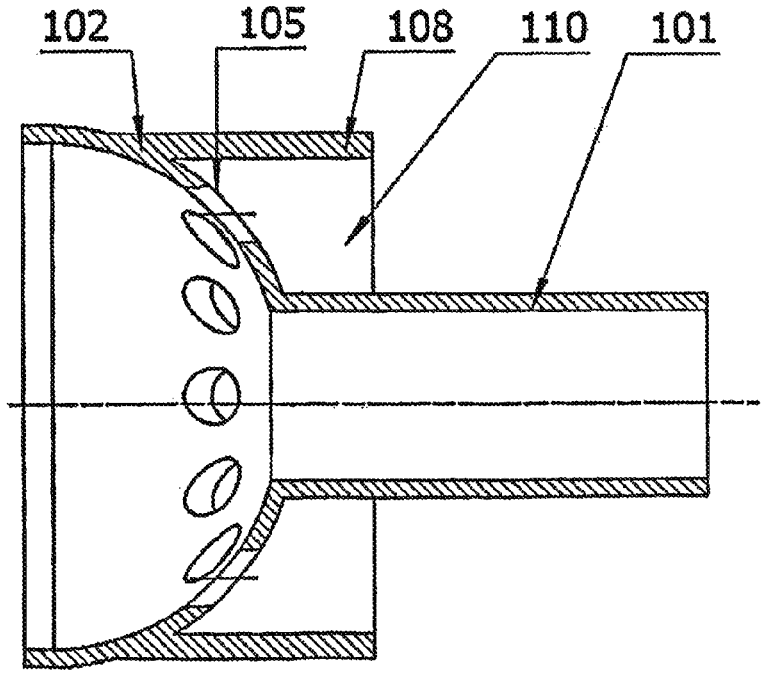
FIG. 8 shows a perspective view of the pulverized coal concentrator according to an eighth embodiment of the present invention.

FIG. 8 shows a perspective view of the pulverized coal concentrator according to an eighth embodiment of the present invention. In this embodiment, the circular bowl-shaped front part 102 is connected via its bowl bottom opening with the inlet of the cylinder-shaped rear part 101. An additional cylinder 108 is provided outside of the rear part 102. This additional cylinder is connected to the wall of the front part 102, so that an interlayer space 110 is formed between the additional cylinder and the cylinder-shaped structure of the rear part. In this embodiment, the additional cylinder 108 is arranged in such a manner that the interlayer space 110 consisted of the rear part inner cylinder and the additional cylinder 108 houses the holes in the wall of the front part 102. It can also be that the additional cylinder 108 is arranged in such manner that the interlayer space 110 consisted of the rear part inner cylinder and the additional cylinder 108 does not house the holes in the wall of the front part 102.

Figure 9:
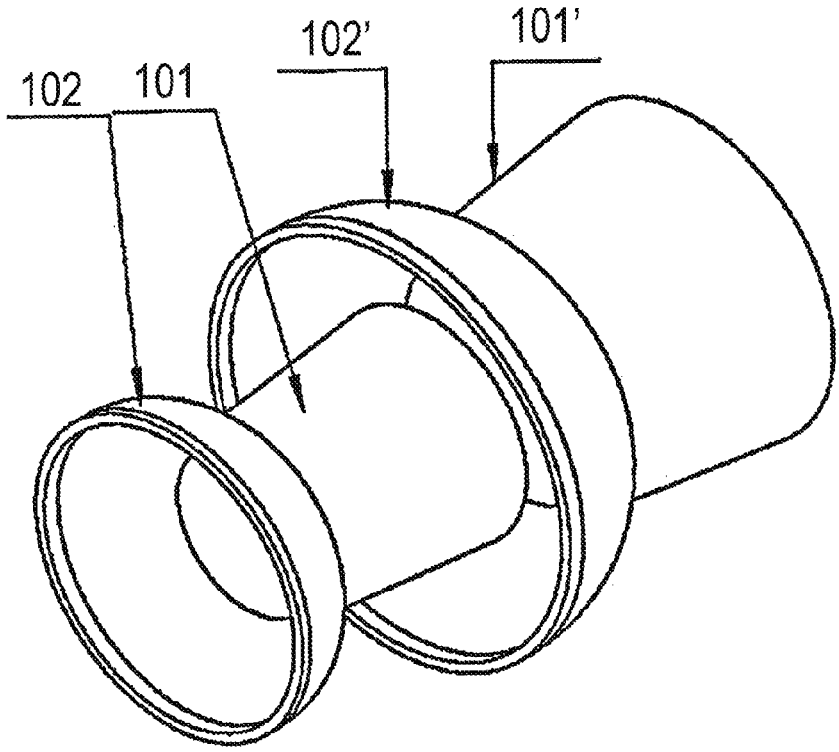
FIG. 9 shows a perspective view of the pulverized coal concentrator according to a ninth embodiment of the present invention.

FIG. 9 shows a perspective view of the pulverized coal concentrator according to a ninth embodiment of the present invention. In this embodiment, a two stage combination structure comprising the front parts 102, 102' and the rear parts 101, 101', wherein the rear part 101 of the first stage structure is nested within the front part 102' of the second stage structure. As for the multiple-stage pulverized coal concentrator structure, it can be analogized accordingly.

Figure 10:
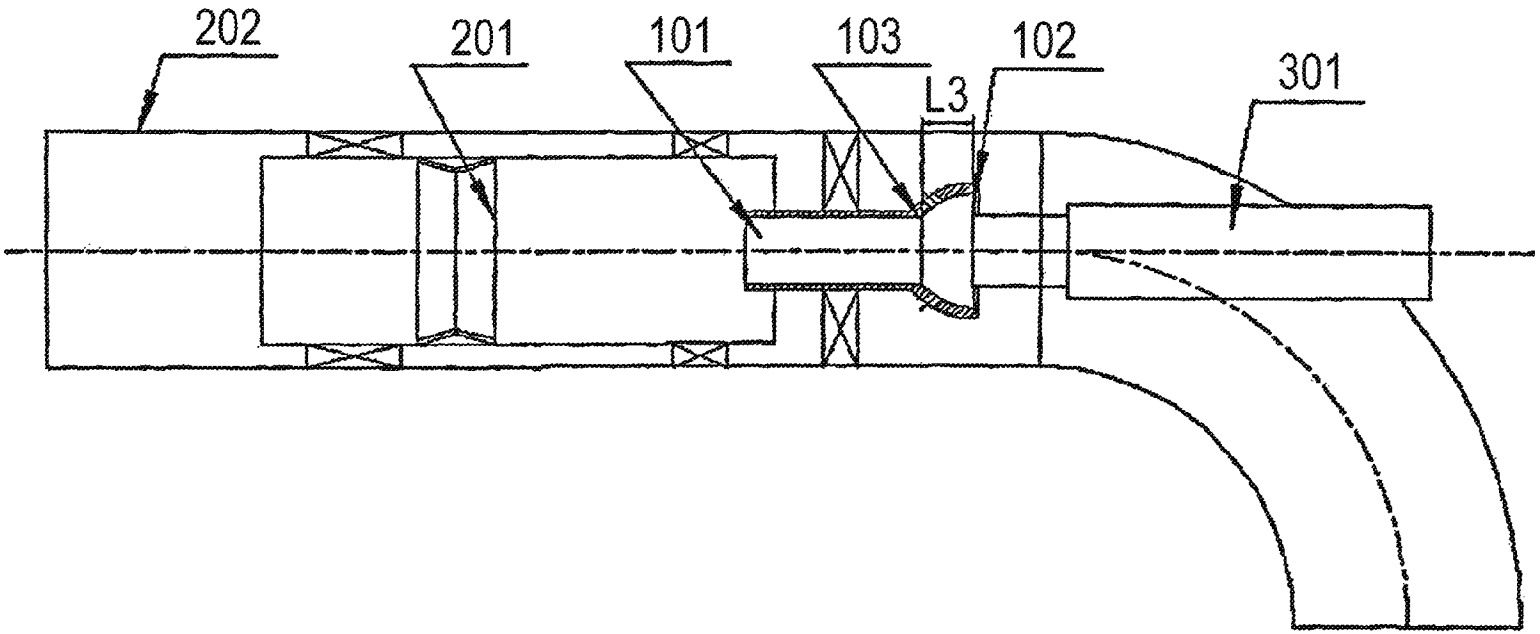
FIG. 10 shows a front view of the pulverized coal burner comprising a present inventive pulverized coal concentrator according to one embodiment.

FIG. 10 shows a front view of the pulverized coal burner comprising a present inventive pulverized coal concentrator according to one embodiment. The pulverized coal burner comprises two stages of burner chambers (the first chamber stage 201, the second chamber stage 202, i.e. outer burner chamber), the pulverized coal concentrator arranged inside the burner and having the rear part 101, the front part 102, holes 105, and a plasma generator 301, wherein the rear part 101 is fixed at the burner (or the front part 102 is fixed at the burner, or the front and the rear parts are fixed at the burner). Herein, connecting means can be used to connect the concentrator to the chamber wall of the burner, so as to fix the concentrator inside the burner, preferably the axis of the concentrator coincides with that of the burner; or connecting means can be used to fix the concentrator to the plasma generator, or other fixation means can be applied. The pulverized coal concentrator is arranged between the plasma generator 301 and the first stage burner chamber 201. The plasma generator 301 projects into the bowl-shape structure of the front part 201 of the concentrator, and/or the outlet of the concentrator, i.e., the outlet of the cylinder-shaped rear part projects into the first stage of burner chamber 201. The plasma generator is spaced from the bowl bottom opening of the front part by a distance of L3 (10-100 mm), Using this distance, firing stabilization can be achieved at maximum and ignition adaptability of coal quality can be improved. Instead of plasma generator, small oil guns or other suitable ignition source can also be used. The plasma generator, the pulverized coal concentrator and the burner chambers are preferably arranged coaxially relatively to one another. Inside the present inventive pulverized coal burner, it is divided into several stages, upon using such a concentrating structure, the ability of heat-collection is enhanced and the strength of burning flame is also increased.

Figure 11:
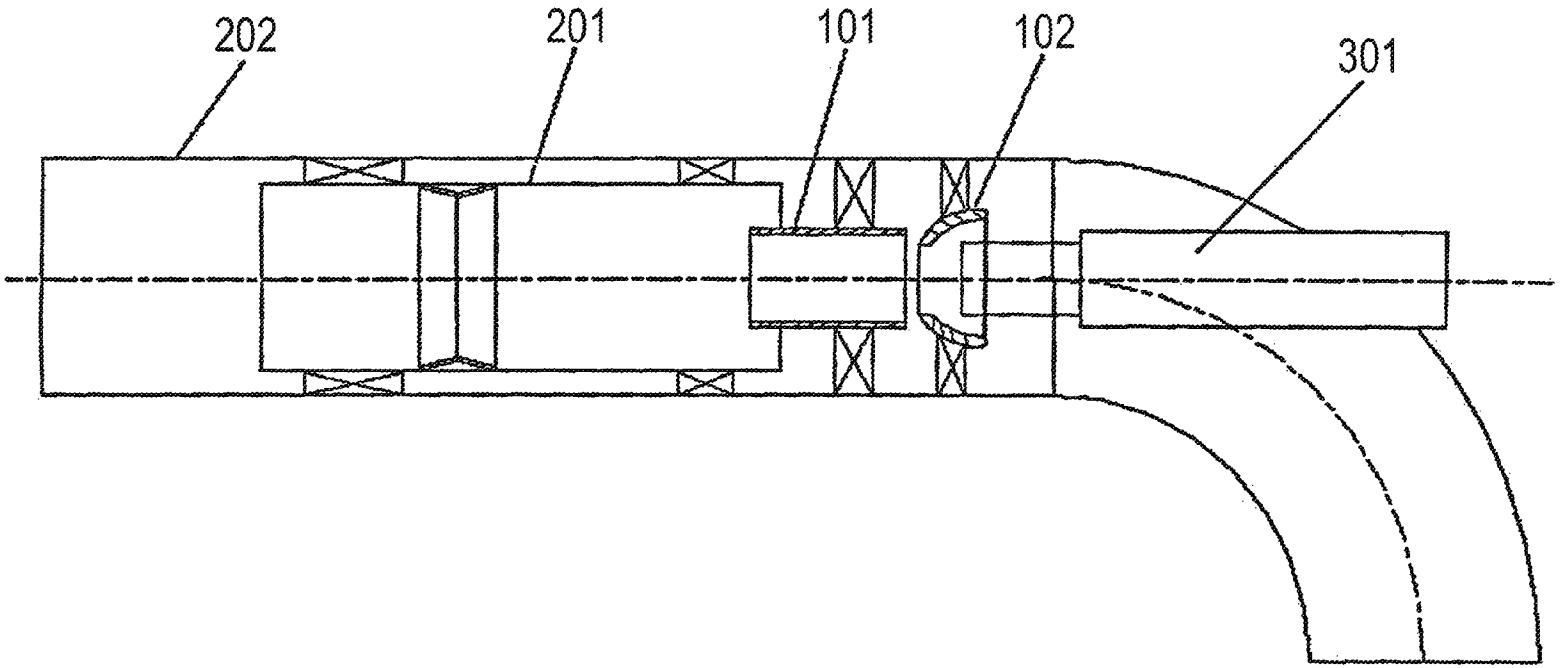
FIG. 11 shows a longitudinal sectional view of the pulverized coal burner comprising a present inventive pulverized coal concentrator according to another embodiment.
Figure 12:
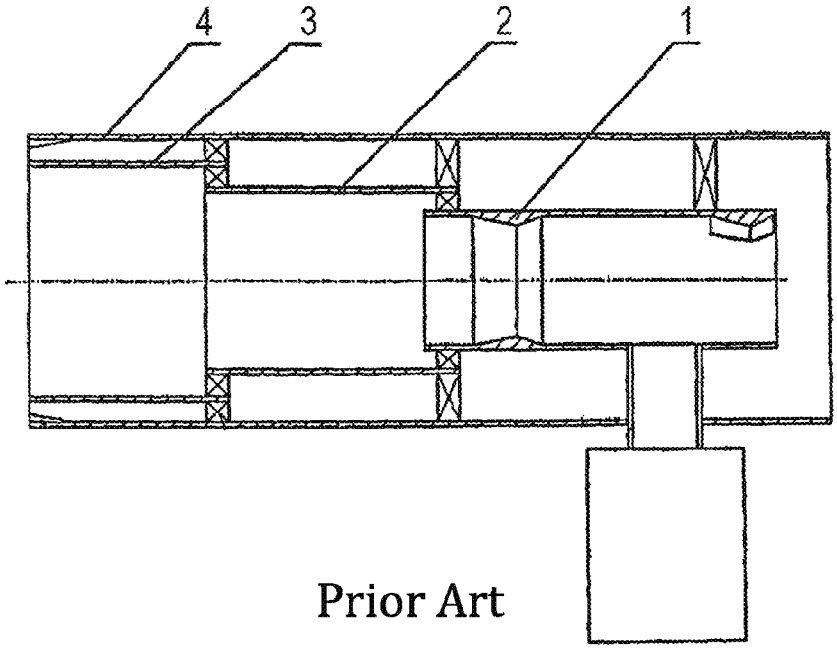
Prior Art Fig. 12
FIGS. 12 and 13 show the pulverized coal burner in the prior art.
Figure 13:
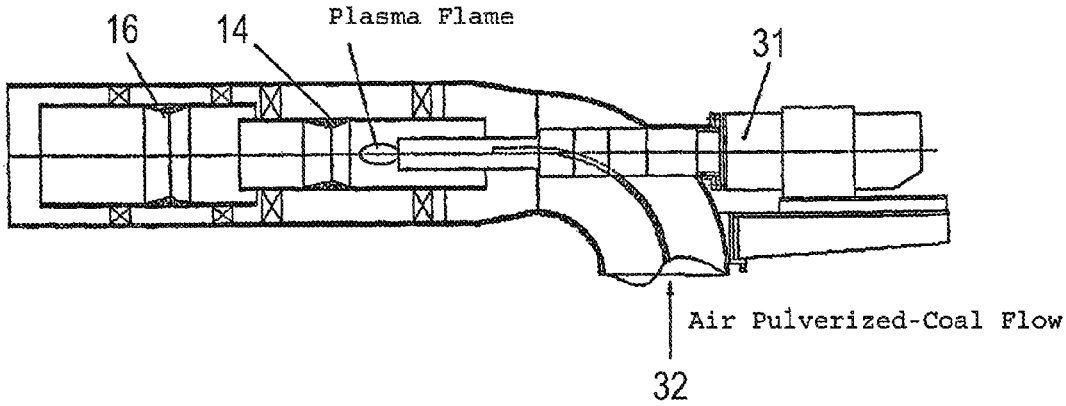
Prior Art Fig. 13

FIG. 11 shows a longitudinal sectional view of the pulverized coal burner comprising a present inventive pulverized coal concentrator according to another embodiment. This embodiment differs from the embodiment shown in FIG. 10 in that the front part 102 and the rear part 101 are arranged apart in a distance and are respectively fixed at the pulverized coal burner, wherein the size of the bowl bottom opening 103 of the front part 102 is preferably smaller than or equal to that of the inlet of the rear part 101, thus it can be realized to supplement air into the rear part so as to optimize combustion and coking on the wall of the rear part can also be avoided. Herein, the distance can be determined the structural size of component parts and the ignition operation condition etc.

In the present inventive pulverized coal burner, after the starting of the plasma generator 301, high-temperature, high-enthalpy value plasma flame is produced, and the pulverized coal and air flow (also "air-pulverized coal flow") comes from the bowl opening 109 into the front part 102 of the concentrator, a portion of the air-pulverized coal flow reaches outside of the concentrator via small holes 105 of the bowl-shaped structure, the dense phase air-pulverized coal flow is retained in the concentrator, so the air velocity inside the concentrator is decreased. The small holes 105 may reduce air velocity and decrease the negative influence on firing due to enlargement of flow velocity. Through the guidance and concentration effect of the bowl-shaped structure (with big bowl opening and small bowl bottom opening), the coal particles are forcedly introduced into the central arc area of the plasma flame with higher temperature, the air pulverized coal flow is concentrated to a density level suitable for ignition, the pulverized coal is rapidly ignited at the initial stage after it is ignited by the plasma flame. The air pulverized coal flow enters via the bowl bottom opening 103 into the rear part 101 to be continuously guided, and finally the glowing flame expands rapidly at the outlet of the concentrator to mix intensively with the pulverized coal in the next stage chamber, producing energy larger than the ignition source to ignite the pulverized coal entering the first chamber 201. After the pulverized coal inside the first stage chamber 201, it then ignites the pulverized coal inside the second stage chamber 202 i.e. the outer chamber, and finally ejects into furnace for combustion.

Of course, the present invention is already described in detail based on the present inventive embodiment; however, the present invention is not limited thereto. The present inventive concentrator has the key point of concept that, the front part of the concentrator is designed as a bowl-shaped structure, for guiding and concentrating a gas-solid two-phase flow consisted of concentrated pulverized coal and air, and the rear part is designed as a cylinder-shaped structure, for maintaining a proper extension of the dense phase zone of the air pulverized coal flow, the combination of both realizes the invention object. The front part and the rear part are referred to with respect to the flow direction of the air pulverized coal flow, in the flow direction, the part located front is a front part and the part located rear is a rear part. The person skilled in the art can easily apply the present inventive pulverized coal concentrator to other related technical field, such as industrial furnace, without exercising inventive skills, as practically required. Furthermore, the present inventive pulverized coal concentrator can also be used to concentrate other fluids, such as other gas-solid two-phase flow. These modification variants and other equivalent variants should be deemed to fall within the protection scope of the present patent application.

The invention claimed is:

1. A pulverized coal concentrator for a pulverized coal burner, the pulverized coal concentrator is fixedly arranged inside the pulverized coal burner and comprises a front part and a rear part, characterized in that, the front part is a bowl-shaped structure, for guiding and concentrating an air-pulverized coal flow, and the rear part is a cylinder-shaped structure, for maintaining a proper extension of the dense phase zone of the air-pulverized coal flow, wherein through holes are made in the bowl-shaped wall of the front part, wherein an additional cylinder is arranged at the outside of the rear part and is connected to the wall of the front part thereby forming an interlayer space between the additional cylinder and the cylinder-shaped rear part, and wherein the interlayer space houses the through holes in the wall of the front part.

2. The pulverized coal concentrator as claimed in claim 1, characterized in that the pulverized coal concentrator is an integral structure, that is, the front part and the rear part are made integrally and the front part and/or the rear part are arranged fixedly; or the pulverized coal concentrator is a split structure, that is, the front part and the rear part are made separately respectively, wherein the front part is connected with the rear part and the front part and/or the rear part are arranged fixedly; or the front part and the rear part are arranged apart in a distance one from another and the front part and the rear part are arranged fixedly respectively.

3. The pulverized coal concentrator as claimed in claim 1, characterized in that the front part has a bowl opening and a bowl bottom opening, an inlet of the rear part is connected with the bowl opening or the bowl bottom opening, or the inlet of the rear part is connected to a wall of the front part between the bowl opening and the bowl bottom opening.

4. The pulverized coal concentrator as claimed in claim 1, characterized in that the cylinder-shaped structure of the rear part is a straight cylinder, a gradually expanding cylinder or a gradually narrowing cylinder, or their combination in various forms.

5. The pulverized coal concentrator as claimed in claim 1, characterized in that a bowl bottom opening of an additional bowl-shaped component is connected to an outlet of the cylinder-shaped rear part, and the bowl opening of the bowl-shaped front part is facing away from a bowl opening of the additional bowl-shaped component.

6. The pulverized coal concentrator as claimed in claim 3, characterized in that the size of the bowl opening is larger than that of the bowl bottom opening.

7. The pulverized coal concentrator as claimed in claim 1, wherein the through holes in the bowl-shaped wall of the front part are in adjacency to the bowl bottom.

8. The pulverized coal concentrator as claimed in claim 1, characterized in that the rear part is provided at its outlet edge with a castellation structure.

9. The pulverized coal concentrator as claimed in claim 1, characterized in that through holes are made in the cylinder-shaped wall of the rear part.

10. The pulverized coal concentrator as claimed in claim 1, characterized in that a multiple-stage combination structure of the pulverized coal concentrators is provided, wherein the rear part of the previous stage of concentrator is nested with the front part of the next stage of concentrator consequently.

11. A pulverized coal burner, characterized in that comprises the pulverized coal concentrator as claimed in claim 1.

12. The pulverized coal burner as claimed in claim 11, characterized in that the pulverized coal burner also comprises at least one stage of burner chamber and an ignition source.

13. The pulverized coal burner as claimed in claim 12, characterized in that the ignition source projects into the bowl-shape structure of the concentrator, and/or the outlet of the concentrator, wherein the outlet of the cylinder-shaped rear part projects into the first stage of burner chamber.

14. The pulverized coal burner as claimed in claim 12, characterized in that the ignition source is a plasma generator, which is arranged in a distance of 10-100 mm from the bowl bottom opening of the front part.

* * * * *

UNITED STATES PATENT AND TRADEMARK OFFICE

CERTIFICATE OF CORRECTION

PATENT NO. : 8,555,795 B2
APPLICATION NO. : 13/257584
DATED : October 15, 2013
INVENTOR(S) : C. Cheng et al.

It is certified that error appears in the above-identified patent and that said Letters Patent is hereby corrected as shown below:

In the Claims

Column 10, Line 43, Claim 11, after "in that" insert --it--

Signed and Sealed this
Eighth Day of April, 2014

Michelle K. Lee

Michelle K. Lee
*Deputy Director of the United States Patent and Trademark Office*